United States Patent [19]

Hwang

[11] Patent Number: 4,974,126

[45] Date of Patent: Nov. 27, 1990

[54] LAMP WITH POWER SOURCE SUPPLY FOR FAN

[76] Inventor: Feng-Lin Hwang, No. 21, Pa Te Rd., Chi Tu District, Keelung City, Taiwan

[21] Appl. No.: 450,488

[22] Filed: Dec. 14, 1989

[51] Int. Cl.[5] ..... F21V 33/00

[52] U.S. Cl. ..... 362/96; 362/183; 362/253

[58] Field of Search ..... 362/96, 183, 253, 20, 362/157

[56] References Cited

U.S. PATENT DOCUMENTS

| | | | |
|---|---|---|---|
| 3,353,191 | 11/1967 | Dahly | 362/183 |
| 4,665,472 | 5/1987 | Chang | 362/294 |
| 4,778,378 | 10/1988 | Dolnick et al. | 431/79 |

*Primary Examiner*—James C. Yeung
*Attorney, Agent, or Firm*—Browdy and Neimark

[57] ABSTRACT

A lamp with a power source to supply a fan, comprising a light installation, a solar cell connected inside of the lampshade, a rechargeable battery to be charged with electrical power by means of the solar cell, and a small fan or other small electrical apparatus attached to the rechargeable battery. As the light installation uses alternating-current, radiation energy sent from the light bulb, is converted by the solar cells's photoelectric effect to provide current again to charge a rechargeable battery, thereby supplying the small fan or any other electrical apparatus (such as shaver, transistor radio) with the required power source to operate, and thereby sav energy.

2 Claims, 2 Drawing Sheets

F I. G. 1

LAMP WITH POWER SOURCE SUPPLY FOR FAN

FIELD OF THE INVENTION

The present invention relates to a lamp with a power source supply for fan, and particularly to a lamp of which the sent radiation energy of the bulb can be partly recycled and converted into the electric currents for use again. By this way conservation of the energy resource is achieved.

BACKGROUND OF THE INVENTION

In terms of light bulbs of presently used lamps, only part of all the consumed electric current goes to transmit lights to provide illumination, while the rest in manner of radiation energy changes into heat to join the air. It is unproper to let unfully used radiation energy vanish this way and to help increase a room's temperature, and affect an air conditioner in its operation.

OBJECT OF THE INVENTION

To solve the shortcoming above, this invention provides a lamp able to provide the fan with its required power source. Its construction includes a solar cell connected inside the lampshade, which takes advantage of the radiation energy sent from light bulb to generate photoelectric effects so as to charge a rechargeable battery with electrical power. The fan uses the recycled electrical power to operate.

SUMMARY OF THE INVENTION

A lamp with power source supply for a fan comprises a light installation, a solar cell, a rechargeable battery, and a direct-current small fan. The solar cell, is connected inside the lampshade and, utilizes the sent radiation energy from the light bulb to generate photoelectric effects, through which the raddiation energy is converted into electrical power to charge the rechargeable battery, to supply a small fan or any other electric apparatus (such as a transistor radio or a shaver) with its required power source. In this way, some of the electricity consumed by the light installation can be recycled again for use.

DETAILED DESCRIPTION OF THE INVENTION

Figure 1:
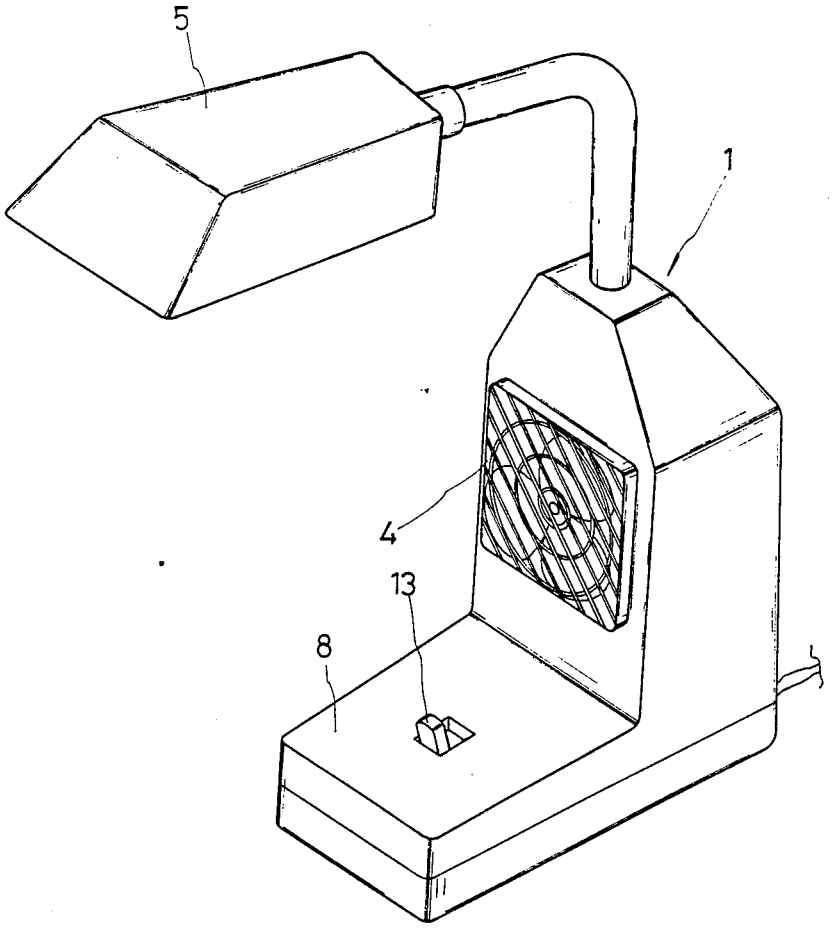
FIG. 1 is a perspective view of a preferred embodiment according to the invention.
Figure 2:
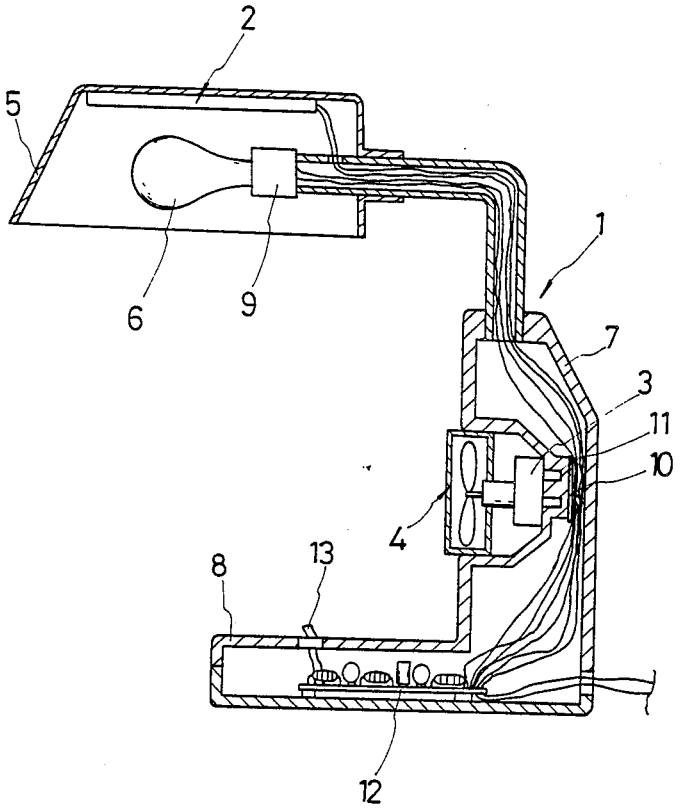
FIG. 2 is a side elevational view of FIG. 1.

As shown in FIGS. 1, 2, the invention consists of a light installation 1, solar cell 2, rechargeable battery 3, and a small fan 4. Light installation 1 is made up by lampshade 5, light bulb 6, supporting bar 7, and seat frame 8; the lampshade 5 is structured generally the same as conventionally used ones, having one end connected with a cross placed light bulb base 9 to screw light bulb 6 thereonto, and to which a solar cell 2 is connected inside of the lampshade, in a position against light bulg 6. In this way, as light bulb 6 is used, solar cell 2 receives the light beams and radiation energy sent by light bulb 6 and by photoelectric effects converts the radiation energy into electricity to charge the rechargeable battery 3 via the charging circuit. The top of supporting bar 7 is connected with lampshade 5 and light bulb 6, and in a bar body there is provided a socket 10, for a small fan 4 attached to the rechargeable battery 3 by a plug 11. The bottom of supporting bar 7 connects to a seat frame 8, which can be any hollow body in any suitable shape containing a PC board 12 arranged with charging circuits and a shifter bar 13 protruding out thereof, so that the rechargeable battery can either be charged by solar cell 2 or via the general charging circuits when necessary. Inside lampshade 5, solar cell 2 having its positive and negative poles each connected with a power lead, which passes by charging circuits to get united with socket 10, can charge rechargeable battery 3 with its attached plug 11 plugging into socket 10. Rechargeable battery 3 is connected to the tail part of small fan 4 in order to unite with small fan 4 as a completely. Being charged, small fan 4 is positioned in a nest arranged in supporting bar 7, and the fan can be used by taking it out holding it in the hand of a user.

Small fan 4 attached with rechargeable battery 3 having plug 11 can make a constant plugged connection with socket 10, so that rechargeable battery 3 can be charged automatically when the light installation 1 is used. If necessary, the general charging circuits in seat frame 8 can also be utilized to charge by means of a shifting shifter bar 13.

It should be understood that this invention can not only charge the rechargeable battery of small fan 4 but also that of any other small electric apparatus, such as shaver, transistor radio, and etc.

I claim:

1. A lamp having a solar cell inside of a lamp shade to convert radiation energy from a light bulb to electrical current to charge a rechargeable battery used to supply direct current to operate small electrical apparatus, comprising:

a lamp having a seat frame connected to a bottom portion of a supporting bar;

a lamp shade connected to a top portion of said supporting bar;

a solar cell connected inside of the lamp shade in a position to receive and photoelectrically convert radiation energy from an illuminated bulb to electric current;

a rechargeable battery disposed in said supporting bar to receive said converted electrical current; and a small electrical apparatus connected to said rechargeable battery.

2. The lamp of claim 1, wherein the small electrical apparatus is a fan.

* * * * *